US005544415A

United States Patent [19]

Huang

[11] Patent Number: 5,544,415

[45] Date of Patent: Aug. 13, 1996

[54] WATER-PROOF AND WASHABLE ELECTRIC RAZOR

[75] Inventor: Joseph Huang, Taipei, Taiwan

[73] Assignee: Kunnex Incorporated, Taipei, Taiwan

[21] Appl. No.: 349,890

[22] Filed: Dec. 6, 1994

[51] Int. Cl.[6] ..... B26B 19/02

[52] U.S. Cl. ..... 30/43.92; 30/210

[58] Field of Search ..... 30/43.92, 43.91, 30/195, 210, 216–220, DIG. 1

[56] References Cited

U.S. PATENT DOCUMENTS

| | | | |
|---|---|---|---|
| 2,271,029 | 1/1942 | Oster | 30/218 |
| 3,589,007 | 6/1971 | Walton | 30/210 |
| 3,842,498 | 10/1974 | Mizobata et al. | 30/43.92 |
| 4,631,825 | 12/1986 | Kuriyama et al. | 30/43.92 |
| 4,989,324 | 2/1991 | Andis | 30/216 |

*Primary Examiner*—Hwei-Siu Payer
*Attorney, Agent, or Firm*—Harrison & Egbert

[57] ABSTRACT

A structure of an electric water-proof detachable and washable razor has a unit of detaching blades and a unit of water-proof shells for receiving a battery, a motor, a switch, etc; these two units can be put together or opened to shave off the useless hair on the body of its user, and can be opened and detached to clean off the hair dust in it so that the shaver can be kept neat and save.

3 Claims, 4 Drawing Sheets

WATER-PROOF AND WASHABLE ELECTRIC RAZOR

TECHNICAL FIELD

The present invention relates to electric razors, generally. More particularly, the present invention relates to water-proof appliances and, in particular, water-proof electric razors.

BACKGROUND OF THE INVENTION

Today, our social custom becomes more open than ever before because it is more obviously influenced by western civilization. We expose more skin and hair on our bodies than before because now we often wear clothes of western modern style. We sometimes think that hair may uglify our appearance, so more and more men and women like to use a razor to eliminate some of their hair. However, there are many types of shavers on the market now, some of them are not water-proof, some are not detachable and washable, some are difficult to assemble. Eventually, the interior of them can be very dirty and not safe enough. Because of these disadvantages, the present invention is a new structure of a razor which is easily cleaned and washed. So the present invention really provides the user a safe and neat product.

SUMMARY OF THE INVENTION

The first characteristic of the invention is that there is a detaching pinch plate on the unit of blades so that the blade unit can be opened for cleaning and washing off the hair dust.

The second characteristic of the invention is that there are two water-proof rubber bushings so that water will not infiltrate into it to affect the function of the electric circuit of the razor.

OBJECTS OF THE INVENTION

The main object of the invention is to provide a fast and easy assembly for production so as to simplify the structure 0f blades and lower its cost to serve the purpose of commercial production.

The second object of the invention is to provide a detachable, washable, and neat razor.

The third object of the invention is to provide the user a water-proof electric shaver so that the razor can be cleaned, washed and sanitary enough.

BRIEF DESCRIPTION OF THE DRAWING FIGURES

DETAILED DESCRIPTION OF THE PREFERRED EMBODIMENT

Figure 1:
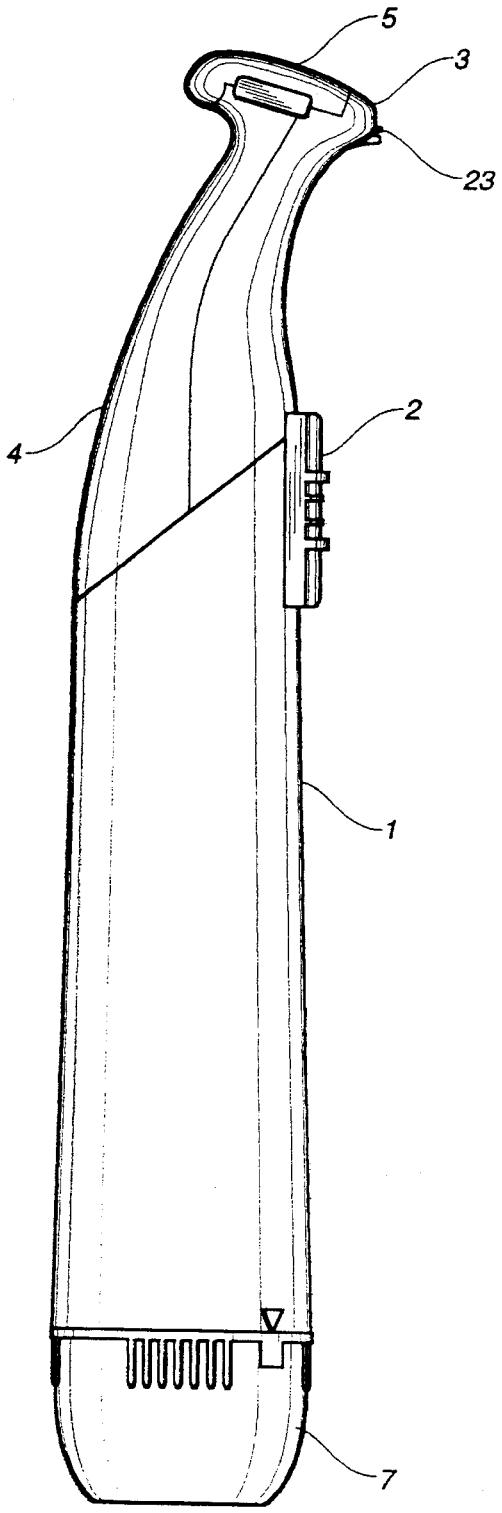
FIG. 1 is a side view of the invention.
Figure 2:
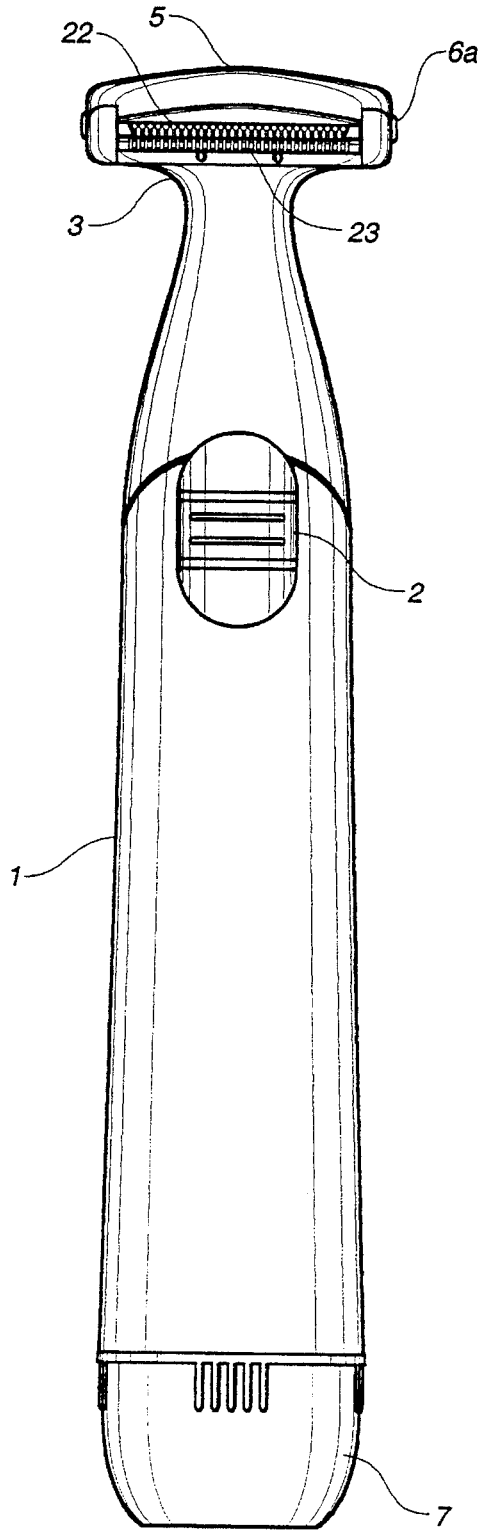
FIG. 2 is a front view of the invention.
Figure 4:
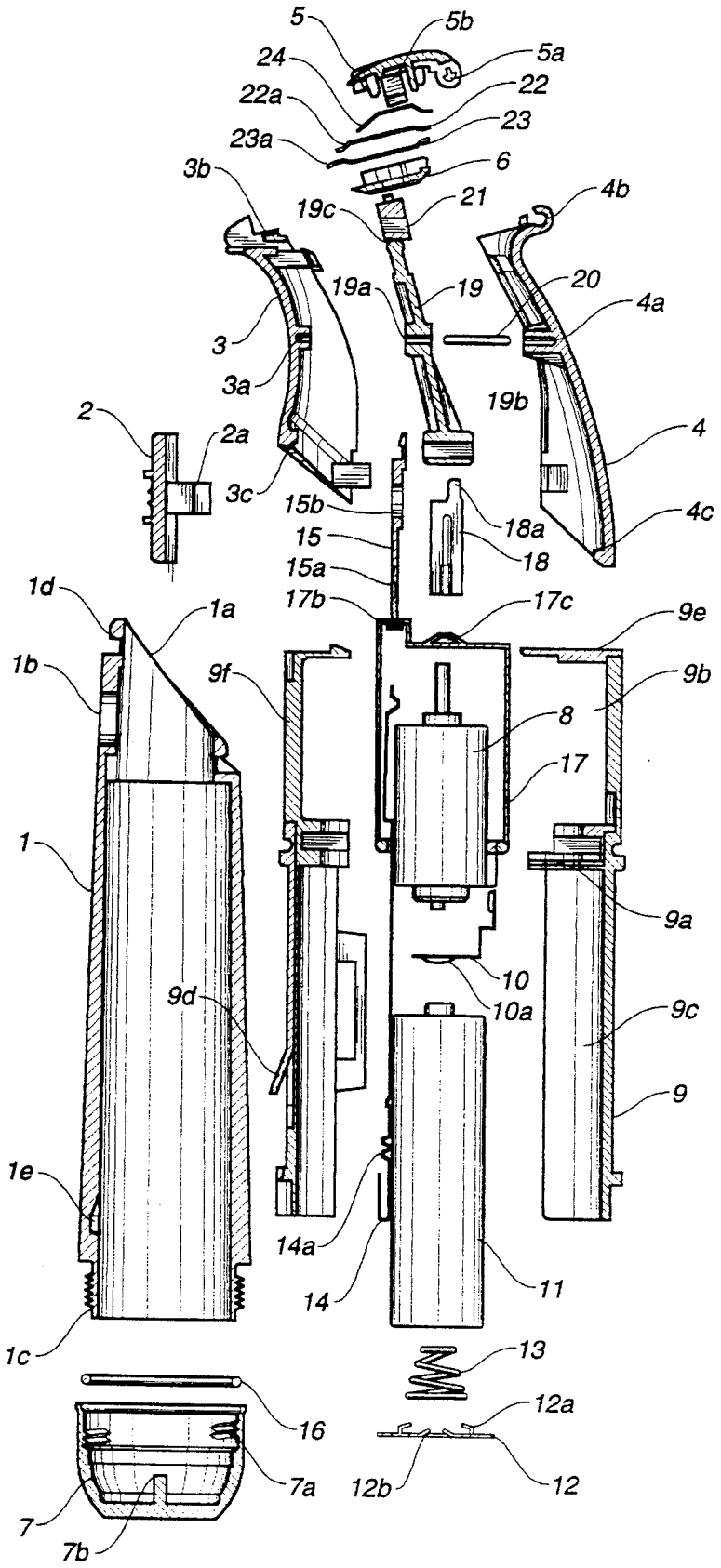
FIG. 4 is a sectional view of an exploded view of the invention.

Now referring to FIGS. 1, 2 and 4 the embodiment is a "T" shaped assembly of an electric razor, wherein grip 1, made of plastics, is a hollow cylinder, the top of the grip 1 is slantedly cut from right side to left side so as to form an upper opening 1*a*. A rectangular hole 1*b* is disposed under the front side of the upper opening la so that a plastic button 2 can be slidingly set in it. The upper opening la of the grip 1 is half joined with a unit of forward-extending necks having a front neck 3 and a back neck 4. The unit is an injection-molded hollow shell which has a "T" shaped upper portion and a cylinderic lower portion. After the front neck 3 and the back neck 4 are half joined with each other, they are also radially rotated to secure on the upper opening 1*a* of the grip 1. A rotating plastic blade lid 5, set in the forward-extending neck, can be secured to the top of the front neck 3 or uncovered from it by means of an outward-extending pinch plate 6*a* of a blade fixing piece 6 under the lid 5. The end 1*c* of the grip 1 is locked by a plastic battery lid 7 shaped like a bowl so as to form the basic exterior shape of the invention.

Figure 3:
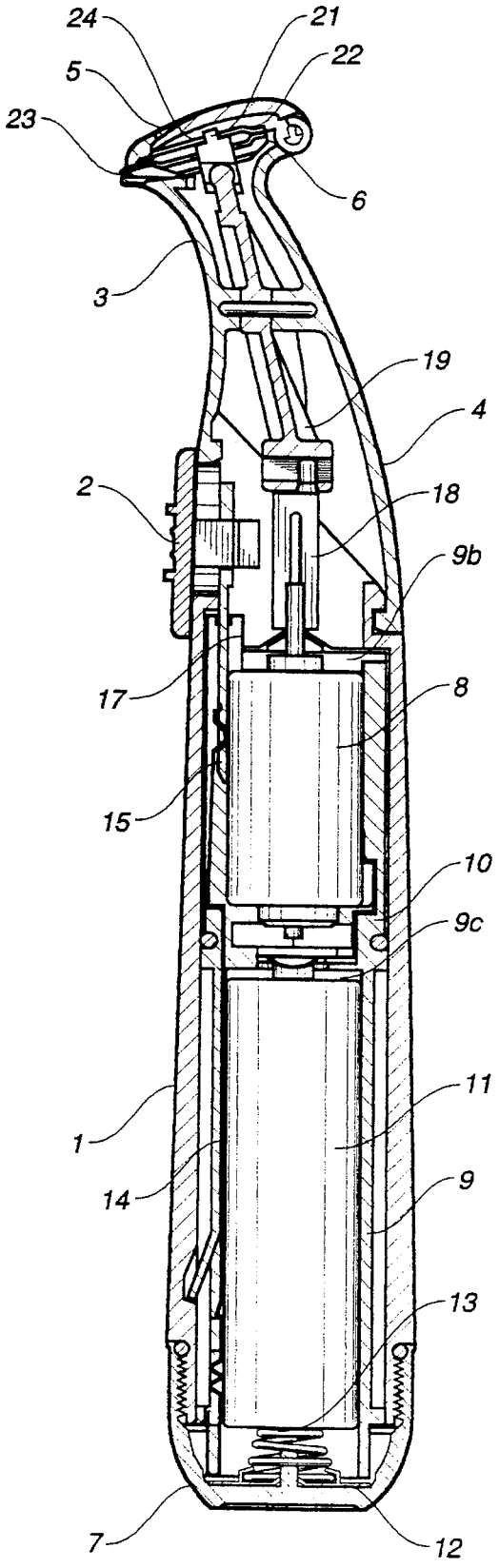
FIG. 3 is a Sectional view of the assembly of the invention.

Now referring to FIGS. 3 and 4, there is shown the sectional view of the assembly concerning its detailed interior structure. A small motor 8 is set in a space in front of an inner socket 9 which is actually a cylinder comprised of a pair of symmetric hollow semicircular shells 9*e*, 9*f*. A dividing plate 9*a* is disposed at the middle of the inner socket 9 so as to divide its interior into the front chamber 9*b* and the back chamber 9*c*. The small motor 8 is disposed in the front chamber 9*b*. A conductive metal piece 10 is disposed on the right side of the front chamber 9*b* so that an electric pole on the small motor 8 can connect with the positive pole of the battery 11 disposed below the dividing plate 9*a*. The sectional plane of a spring piece 10 is shaped like two bent "L" connected together, and an arc piece 10*a* of contact point is disposed on the left side of its each ends so as to keep a close contact between the spring piece 10 and the battery 11. As such, the battery 11 is pushed into the back chamber 9*c* of the inner socket 9. And, in order to transfer the negative pole of the end of the battery 11 to the small motor 8, a metal plate 12 is disposed on the bottom of the battery cover 7, and a plurality of hooks 12*a* are disposed on the tray 12 so as to receive a taper spring 13 on it and to maintain a close contact between the spring 13 and battery 11. Opposite to the spring piece 10, there disposed a longitudinal connecting spring piece 14 made of conductive metal. At the end of the spring piece 14, there disposed a "U" shaped bending end. Near the bending end, there is disposed a section of corrugated spring piece 14*a* so that spring piece 14 can surely press on the metal tray 12. The front section of the spring piece 14 tends to bend like an "L" to form an acute angle so that its front end can have an elastic pressing force to press the negative load end of the outer shell of the small motor 8. Therefore, the front end of the connecting spring piece 14 is bent inward to form a "V" shaped end so as to press on or be pushed away from the outer shell of the small motor 8.

To control the operation of the small motor 8, at the front end of the connecting spring piece 14, there is disposed a rectangular plastic slide 15. At the end of the slide 15, there is disposed a horn 15*a* to provide a space for the connecting spring piece 14 to contact with the negative pole on the outer shell of the small motor 8. If the slide 15 is moved, the spring piece 14 will be pushed away and the power source of the small motor will be cut off. A rectangular hole 15*b* is disposed in front of the slide 15 so as to connect with an outer button 2. Made of plastic, the oval button 2 has a pair of hooks 2*a* in it. The hooks 2*a* can set into the rectangular hole 15*b* of the slide 15.

A water-proof cylindric rubber socket 17 is disposed on the outer surface of the front chamber 9*a* of the inner shell 9. And, at the end 1*c* of the grip 1, there is disposed an outer thread, and on the top of the thread there is disposed a water-proof rubber collar 16 so as to prevent water-leakage when the plastic battery lid 7, by means of its inner thread 7*a*, is closely locked onto the outer thread of the end 1*c* of the grip 1. At the top of the water-proof rubber 17, there is disposed two holes, one hole 17*b* is for the slide 15 to set in, the other hole 17*c* is for a rotating shaft of the small motor 8 to set in.

The rotating shaft of the small motor 8 is inserted in a transmission shaft 18. An eccentric shaft 18*a* is disposed on the top of the transmission shaft 18. The eccentric shaft 18*a* drives a swinging lever 19 to swing. At the center of the swinging lever 19, there is disposed a shaft hole 19*a* for a central pin 20 to insert into. Both ends of the central pin 20 are respectively inserted into the inner holes 3*a*, 4*a* of the front neck 3 and back neck 4. At the end of the swinging lever 19, there is disposed a horn head 19*b*. The size of the horn head 19*b* is just suitable to be set in the eccentric shaft 18*a* of the transmission shaft 18, so the round post thread 19*c* is disposed on the top of the swinging lever 19 when the small motor 8 is rotating to do simple harmonic motion.

The round post head 19*c* of the swing post lever 19 is set on a coupled block 21, which has a horn opening at the setting spot. When blade lid 5 is uncovered or closed, the swinging lever 19 and the coupled block 21 can be easily connected or separated. At the top of the coupled block 21, there is disposed a slightly convex round post to connect with a moving blade 22. The moving blade 22 is a rectangular blade made of thin stainless steel. Its front edge is slightly folded and molded to become a zigzag blade 22*a*. Under the moving blade 22, there is disposed a non-moving blade 23, which is made of the same material and has a longer but symmetric front edge with the moving blade 22. When the swinging lever 19 is swung because of the simple harmonic motion, the moving blade 22 will raze the hair close to the tooth-like blade edges 22*a*, 23*a* or between the moving blade 22 and the non-moving blade 23. To maintain the closeness between these two blades 22, 23, a thin and light metal spring piece 24 is disposed on the moving blade 22 so as to hold the upper edge of the tooth-like blade 22*a* of the moving blade 22. A snap 24 has a round hole for a slightly convex round post on the driving block 21 to set in it and to be in position. At this time, the moving blade 22 is closely clamped between these two blades 22, 23.

For the convenience of the user to clean the hair dust remaining in the razor, the blade is designed to be detachable. A radial shaft 5*a* is disposed at the end of the blade lid 5. At the back of the top of the back neck, there is disposed an elastic shaft hole 4*b*, which has an opening on its inner side for the radial shaft 5*a* to insert in it. The blade fixing piece 6 is disposed under the non-moving blade 23; and by means of its slot 6*b* and a pair of reverse hooks 5*b*, in the blade lid 5, the blade assembly can be completely put together.

Figure 5:
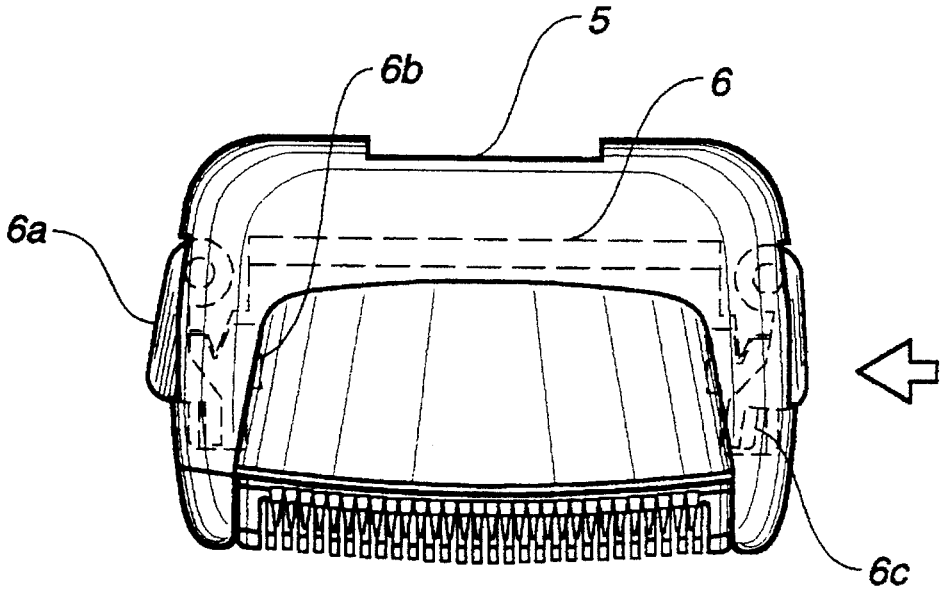
FIG. 5 is a schematic view of assembly of the blade fixing piece of the invention.

Referring to FIG. 5, at both sides (left and right) of the blade fixing piece 6, there is disposed a pair of outward-extending pinch plates 6*a*. An outward-extending reverse hook 6*c* is disposed on its side wall and can be inserted in the slot 3*b* of the top of the front neck 3 so as to join the blade assembly and the hair razor main body. Because the blade fixing piece 6 is a thin plastic piece, when its outward extending pinch plate 6*a* is pressed or clamped by outer force, its reverse hooks 6*c* will contract inward so as to open the blade assembly. This is one of the important characteristics of the invention.

For the long-term maintenance of the razor, inward tooth-claws 3*c*, 4*c*, are disposed on the inner flange of the lower portion of the front 3 and back neck 4, and a concave 1*d* is disposed at the upper opening la of the grip 1. Because, the round opening 1*a* slants to the right, the front neck 3 and back neck 4 can be radially rotated to secure to or separate from the main body. Therefore, the necks 3, 4 can either match and join with each other tightly, or separate fast and easily so that the user can clean the hair dust in the upper portion of the grip 1. This is another important characteristic of the invention.

With respect to the assembly of grip 1, now refer to FIG. 4, all of the transmission shaft 18, the water-proof rubber socket 17, and slide 15 can be set in the inner shell 9 and the inner shell 9 can be put in the interior of the grip 1 and be secured in it by setting a reverse hook 9*d* into the concave hole 1*e* of the grip 1 under the inner shell 9. And, to stabilize and secure the metal tray 12, a positioning pin 7*b* is disposed on the bottom of the battery lid 7 and a plurality of tapered claws 12*b* are disposed at the center of the metal tray 12 so that the pin 7*b* can be clamped by the claw 12*b* and they can match and join with each other.

Figure 6:
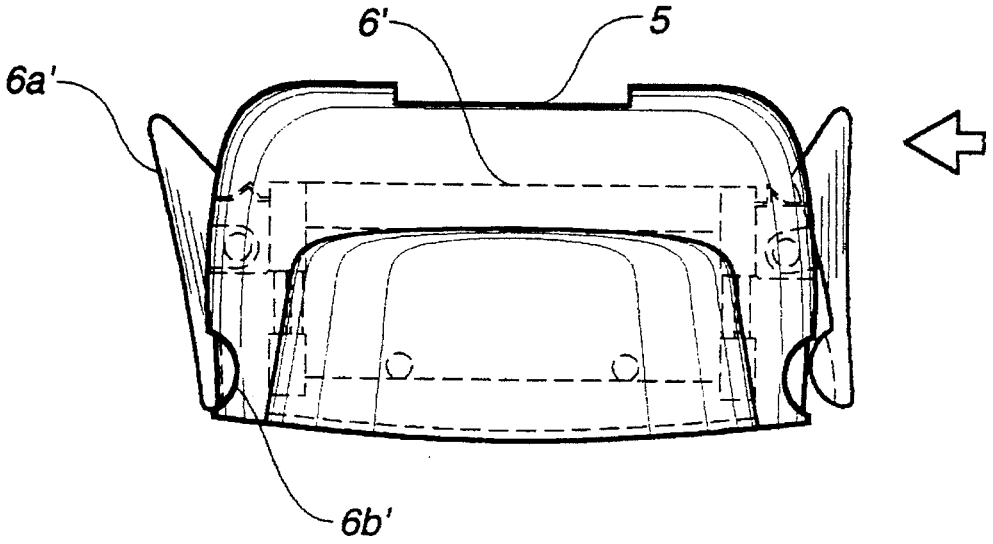
FIG. 6 is a schematic top view of another blade fixing piece of the invention.

As for the structure of the detachable blade, now referring to FIG. 6, by means of squeezing and pressing backward the outward-extending pinch plate 6*a'* of the blade fixing piece 6', the clamped slot 6*b'* can get away from the blade lid 5 so as to serve the purpose of selecting different combinations.

What is claimed is:

1. A waterproof and washable electric razor comprising:

an inner shell having an upper chamber and a lower chamber on an interior of said inner shell, said lower chamber receiving a battery therein, said upper chamber receiving a motor therein, a spring piece being fitted in said upper chamber, said spring piece extending into said lower chamber so as to connect with a negative terminal of said battery, said spring piece connecting with a positive pole of said motor so as to transfer energy from said battery to said motor, said inner shell being positioned within a hollow generally cylindrical grip, said motor having a shaft interconnected with a swinging lever, said swinging lever connected to a driving block so as to move a moving blade back and forth relative to a non-moving blade, said moving blade being positioned in close proximity to said non-moving blade, a slide member movably positioned on said inner shell and in said cylindrical grip so as to control a contact between said spring piece and the pole of said motor, a button secured to said slide member and disposed on an outer surface of said cylindrical grip, said button arranged so as to maintain contact with said spring piece by a reverse hook penetrating through a hole on said cylindrical grip;

a waterproof socket positioned on a surface of said inner shell so as to prevent water infiltration into said inner shell, a rubber collar disposed between an end of said cylindrical grip and said battery, said swinging lever having a center of rotation disposed in-between a front neck and a back neck of said cylindrical grip, said back neck having a shaft hole at its top end for receiving a shaft at an end of a blade lid, said blade lid receiving said spring piece and said moving blade and said non-moving blade through a pair of reverse hooks in a blade fixing piece, said blade fixing piece having sides exposing themselves outside of said blade lid and said front neck and said back neck, said pair of reverse hooks being pressable by an outside force such that said blade lid is uncovered outside said front neck; and a claw on an inner wall of a lower portion of each of said front and back necks so as to connect with or disconnect from a concave surface on an upper edge of said cylindrical grip so as to open an interior of said cylindrical grip.

2. The razor of claim 1, wherein said blade fixing piece being elastic and further comprising:

a hidden snap extending outwardly from said blade fixing piece, said hidden snap having an upper portion affixed within said blade lid and a lower portion affixed within said inner wall.

3. The razor of claim 1, said cylindrical grip having a slant opening on a top surface of said cylindrical grip, said slant opening having an outer diameter which is smaller than an outer diameter of said cylindrical grip below said slant opening, a radial helical surface slants downwardly between said slant opening and said cylindrical grip, a concave surface being disposed between said slant opening and said cylindrical grip, said concave surface being disposed on an inner wall of each of the front and back necks so as to enable said necks to separate from said cylindrical grip.

* * * * *